United States Patent [19]

Saleeby

[11] 4,166,297

[45] Sep. 4, 1979

[54] BATHTUB SAFETY CHAIR

[76] Inventor: Edward W. Saleeby, 4828 Jutland Dr., San Diego, Calif. 92117

[21] Appl. No.: 877,082

[22] Filed: Feb. 13, 1978

[51] Int. Cl.[2] ..... A47K 3/12

[52] U.S. Cl. ..... 4/185 S; 108/47; 297/183; 297/450

[58] Field of Search ..... 4/134, 185 R, 185 S, 4/185 L, 185 AB, 185 B, 185 H, 185 HB, 173 R, 175; 108/47; 297/183, 445, 450, 383; D23/52, 53, 55, 69

[56] References Cited

U.S. PATENT DOCUMENTS

| | | | |
|---|---|---|---|
| 1,197,657 | 9/1916 | Orofino | 4/185 S |
| 1,240,479 | 9/1917 | Nichols | 4/185 S |
| 1,766,085 | 6/1930 | Rumer | 108/47 X |
| 2,142,263 | 1/1939 | Bentz | 4/185 S |
| 2,549,506 | 4/1951 | Moore | 4/185 H |
| 2,815,513 | 12/1957 | Tilson et al. | 4/185 H |
| 3,855,646 | 12/1974 | Glickman | 297/383 X |
| 3,951,454 | 4/1976 | Tantlinger | 297/183 X |
| 4,034,425 | 7/1977 | Riemsdyck | 4/185 S X |
| 4,100,628 | 7/1978 | Franzl | 4/185 S |

*Primary Examiner*—Stuart S. Levy
*Attorney, Agent, or Firm*—Knox & Knox

[57] ABSTRACT

A safety chair for placement in a bathtub and for use by the handicapped and the elderly particularly, being characterized by means for attachment of the chair back to a wall, an one pair of legs to the floor in front of the bathtub, as well as having frame members which saddle the front side rim of the bathtub for maximum stability of the chair in use while permitting intentional removal of the chair, the chair back being inclined for comfort and having a handhold critically positioned for convenience and safety of the user.

7 Claims, 3 Drawing Figures

BATHTUB SAFETY CHAIR

BACKGROUND OF THE INVENTION

Several bathtub chairs, stools and seats have been developed and some patented, all purporting to aid invalids and others to occupy a bathtub for sponge baths or shower baths in the sitting position. A foldable seat supported solely by the front side and rim of the bathtub is disclosed in U.S. Pat. No. 2,142,263, this foldable seat having minimal stabilizing means. A more stable construction is disclosed in Pat. No. 2,815,513 which does have a multiple wall attachment means for a frame encompassing the top of a bathtub and a seat disposed over the outside rim of the bathtub. Several other designs show seats which can simply be placed in the bathtub.

There exists a need, however, for a bathtub seat which invalids and elderly persons may use with confidence in the stability of attachment to assist such persons in getting into and out of the bathtub safely while still permitting the intentional removal of the chair from the bathtub when desired.

SUMMARY OF THE INVENTION

As claimed, the hereindisclosed structure is a satisfactory response to the need mentioned immediately above, comprising a chair having forward and rear members with short legs which rest on the bottom of the bathtub and longer legs securable to the floor in front of the bathtub, a chair seat and a bathtub rim engaging saddle both supported by these legs and an inclined chair back securable positively to a wall behind the bathtub and having a handhold positioned reasonably close to this wall so that the users can steady themselves with convenience and safety while getting into and out of the tub.

DETAILED DESCRIPTION OF A PREFERRED EMBODIMENT

Figure 1:
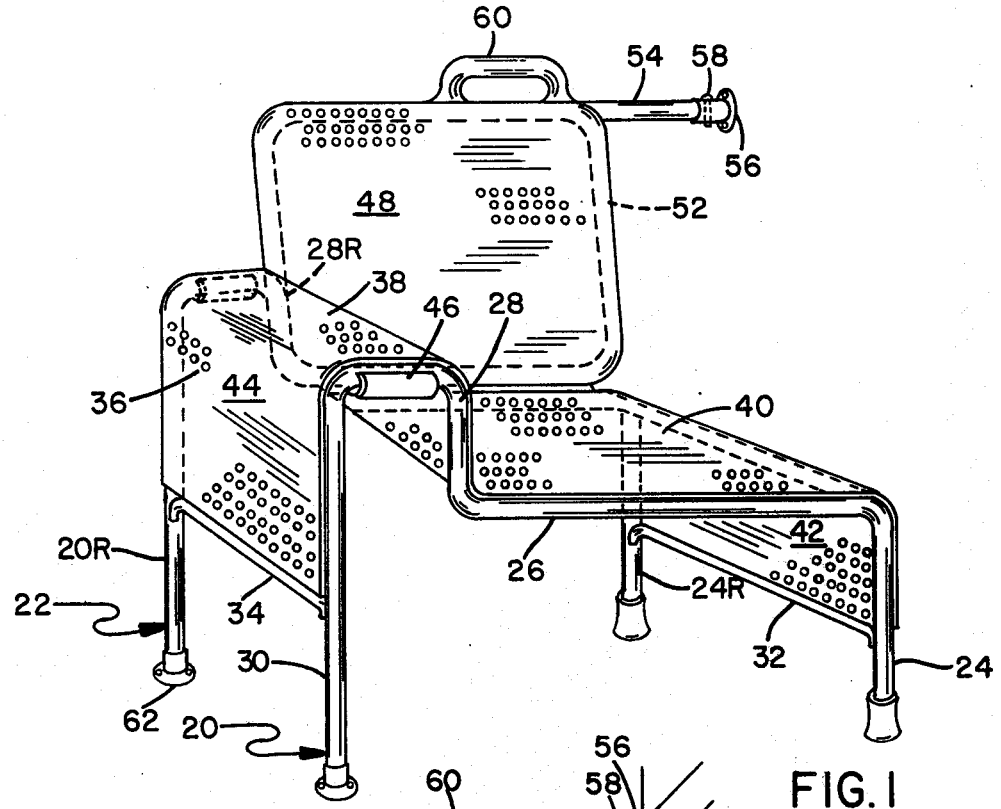
FIG. 1 is a perspective view of the safety chair.
Figure 2:
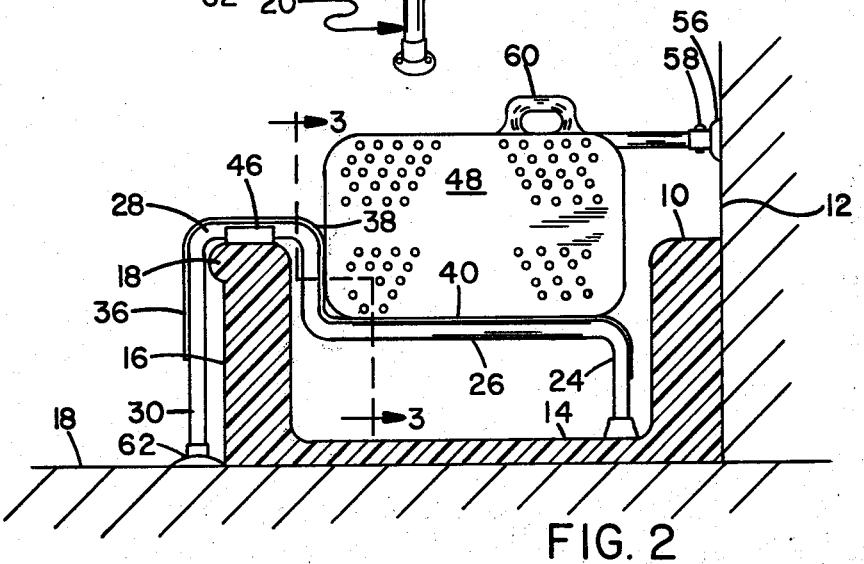
FIG. 2 is a front elevation of the chair with a wall and floor indicated and a bathtub in cross section.

Referring now to the drawing, the safety chair is constructed for use with a bathtub having a back 10 adjacent to or abutting a wall 12, a bottom 14 which will be generally flat, and a front side 16 upstanding from the floor indicated at 18. The drawing shows the floor level to be slightly below the level of the inside surface of the bathtub and this variation may be zero or considerably greater in installations where the bathtub is sunken. The front side 16 of a bathtub wherewith this invention will be used will have a top rim 18.

The safety chair comprises two frame members which for purposes of this disclosure will be considered the forward frame member generally indicated by the numeral 20, and the rear frame member generally indicated by the numeral 22, named to suggest their location with reference to the fact that users will seat themselves facing one end of the bathtub. The frame members 20 and 22 are similar in size and configuration, each being made of a single section of cylindrical metal stock which may be tubular. Each of said frame members comprises a first leg 24 and 24R, a horizontal portion 26 and 26R, an inverted U-shaped portion 28 and 28R and a second leg 30 and 30R. A pair of brace members 32 and 34 are secured to and between the frame members, ordinarily by welding, to hold the frame members in spaced parallel and opposed relation.

A panel of strong sheet material 36, preferably perforated or woven metal cloth, is draped over and between and secured to the frame members, at least over the inverted U-shaped portions 28 and 28R and over the horizontal portions 26 and 26R thereof, thus defining an arm rest generally indicated at 38 to saddle the top rim 18 of the bathtub, and defining a chair seat 40. As shown the sheet material is also preferably extended and secured to and between the outer faces of the legs 24 and 24R, and 30 and 30R as indicated at 42 and 44, these vertical panel portions 42 and 44 extending to and complementing the braces 32 and 34 in strengthening the chair structure.

Protection pads 46, which may be split portions of rubber tubing, are secured to the uppermost portions of the inverted U-shaped portions 28 and 28R to prevent defacement of the top rim 18 of the bathtub.

Figure 3:
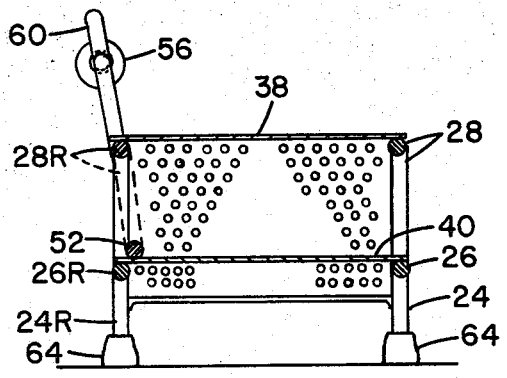
FIG. 3 is a sectional view of the chair, taken on the line 3—3 of FIG. 2.

An inclined chair back 48 comprises a panel of strong sheet material, which can be similar to the panel 36, peripherally supported by a back frame member 52. This member 52 will ordinarily be tubular metal stock similar to the frame members 20 and 22, generally rectangular in shape with radiused corners. The lower edge portion of the chair back 48 is secured again as by welding, to the adjacent edge portion of the chair seat 40, preferably at the forward side of the horizontal portion 26 of the rear frame member 22 as indicated in FIG. 3 at 52. A side edge of the chair back 48 is also welded to the adjacent portion of the inverted U-shaped portion 28R of the rear frame member 22 so as that the chair back is slightly inclined upwardly and rearwardly as best indicated in FIG. 3.

An important feature of this invention is the provision of means for positive securement of the chair back 48, and indirectly the entire chair, to an adjacent wall 12. This is accomplished by an inflexible bar 54 unitary with and extending from the top of the chair back horizontally well beyond that edge of the chair back remote from said arm rest 38 to span the back 10 to the bathtub and equipped with a wall attachment bracket 56 having a simple connecting pin 58, or the like, to make intentional release of the chair from the wall possible.

A handhold 60 is integrated with the top of the chair back 48, reasonably close to the bracket 56 to provide maximum support with convenience to the user of the safety chair. By placement of the handhold close to bracket 56 the psychological as well as the actual physical effectiveness thereof is increased.

Finally, floor mounted brackets 62 are provided to engage the lower ends of the second legs 30. These brackets 62 may be of the male or female type to engage the legs 30 and 30R firmly in use, yet preferably intentionally releasible to permit removal of the chair. Resilient material terminals such as walking cane tips 64, or the like, are inserted onto the lower ends of the first legs 24 and 24R so that the interior finish of the bathtub bottom 14 is not damaged.

The method of using this invention will be obvious from a consideration of the foregoing description.

What I claim as new and desire to secure by Letters Patent is:

1. A safety chair for use with a bathtub of the type having a back abutting a wall, a bottom, a front side upstanding from the floor and terminating in a top rim, said safety chair comprising:

(a) a forward frame member and a rear frame member of similar configuration, each including a first leg for engagement with the bottom of the bathtub, a horizontal spanner portion, an inverted U-shaped portion dimensioned to saddle the front side rim of the bathtub, and a second leg dimensioned to engage the floor in front of the bathtub, said U-shaped portion being disposed between said spanner portion and said second leg, said legs and portions of each frame member being unitary;

(b) brace members secured to and holding said frame members in spaced, parrallel, opposed relation;

(c) a strong panel of sheet material draped over said spanner and U-shaped portions and secured thereto to constitute, respectively, a chair seat and an arm rest to saddle the front side top rim of the bathtub; and (d) a chair back mounted on the arm rest on said rear frame member adjacent the chair seat and having means for positive securement of the chair back to a wall comprising an inflexible bar extending horizontally well beyond the chair back in a direction opposite to said U-shaped portions, and wherein said panel of sheet material extends downwardly between and is secured to the outer face of each said first leg and of each of said second leg to strengthen the chair structure thereby stabilizing the chair for safe use by handicapped and elderly persons.

2. A safety chair according to claim 1 wherein each said second leg (30 and 30R) has means for securement thereof to a floor, thereby further stabilizing the chair.

3. A safety chair according to claim 2 wherein said means for securement of the second legs comprises bracket means positively securable to the floor and engageable with said second legs.

4. A safety chair according to claim 1 wherein said means (d) includes wall attachment means capable of being intentionally released from said wall.

5. A safety chair according to claim 1 wherein said chair back is inclined upwardly and rearwardly.

6. A safety chair according to claim 1 and including a handhold on said chair back adjacent to said means for positive engagement with a wall for maximum support and convenience of a user.

7. A safety chair according to claim 1 wherein said panel of sheet material is perforated metal.

* * * * *